United States Patent [19]

Dörner

[11] 4,302,909

[45] Dec. 1, 1981

[54] STRESSED INTERNAL FACE LAPPING TOOL

[75] Inventor: Hubert Dörner, Burscheid, Fed. Rep. of Germany

[73] Assignee: Goetze AG, Burscheid, Fed. Rep. of Germany

[21] Appl. No.: 103,602

[22] Filed: Dec. 14, 1979

[30] Foreign Application Priority Data

Dec. 20, 1978 [DE] Fed. Rep. of Germany ..... 2854952

[51] Int. Cl.[3] ..... B24B 25/00

[52] U.S. Cl. ..... 51/157; 51/161; 51/352; 51/325

[58] Field of Search ..... 51/157, 161, 325, 354, 51/352, 353, 290

[56] References Cited

U.S. PATENT DOCUMENTS 1,421,203 6/1922 Ford ..... 51/290 UX
1,654,736 1/1928 Kistner ..... 51/290
2,195,056 3/1940 Wallace ..... 51/157
2,318,837 5/1943 Connor ..... 51/157

OTHER PUBLICATIONS

"Lappen", German publication by von Walterlatzig, dated prior to 12/20/78.

*Primary Examiner*—Harold D. Whitehead
*Attorney, Agent, or Firm*—Spencer & Kaye

[57] ABSTRACT

An apparatus for lapping an external circumferential arcuate face of a workpiece includes an axially split, radially resiliently expandable sleeve having an inner face constituting a lapping surface, an axial clamping arrangement for immobilizing the sleeve in a radially resiliently expanded condition. The apparatus has an operative state in which the sleeve is immobilized by the clamping arrangement in the radially resiliently expanded condition in which the inner diameter of the sleeve corresponds to a desired working diameter of the apparatus.

9 Claims, 3 Drawing Figures

STRESSED INTERNAL FACE LAPPING TOOL

BACKGROUND OF THE INVENTION

This invention relates to an apparatus for lapping the external circumferential face of workpieces, particularly the running face of piston rings which, for this purpose, are combined into a stack. The apparatus comprises an axially slit hollow body whose inner face constitutes the lapping surface of the apparatus.

During the lapping operation, the workpiece slides, with its surface to be polished, on the corresponding counterface (lapping face) of the lapping tool and, during this occurrence, the loosely applied lapping agent between the two relatively moving surfaces performs its lapping (polishing) function. The abrasive granules contained in the lapping agent slide and roll between the two relatively moving surfaces and thus exert both friction and pressure thereon. During this operation, one part of granules becomes embedded into the tool and into the workpiece and are held fixedly therein so that they will have a scraping and cutting effect on the respective other surface. The auxiliary material contained in the lapping agent such as fat, oil or other liquids enhances the lapping effect. The removal of material from the workpiece during this process is thus intentional and results in the desired lapping effect; in contradistinction, the material removed during this process from the tool represents undesirable tool wear.

For an arcuate lapping (that is, for a lapping of external faces of arcuate shape) closed sleeves have been used as the lapping tools. Such tools are, for reasons discussed above, exposed to a relatively large wear. Further, lapping dies or lapping rings, have also been used for arcuate lapping. These tools are reciprocated linearly on the rotating workpiece. Such a lapping process is described, for example, in W. LÄTZIG, LÄPPEN-GRUNDLAGEN AND PRAKTISCHE ANWENDUNG (Lapping—Principles and Practice), published by Carl Hanser Verlag, Munich. (1950)

Lapping dies essentially comprise a die block having a bore which corresponds to the workpiece diameter and at least one slot extending radially with respect to the bore axis. With the aid of a setscrew threadedly engaging the die block and bridging the slot, the lapping die can be adjusted during the lapping operation as required. A lapping ring, on the other hand, comprises a rigid slotted ring whose axial length is about ¼ shorter than the length of the workpiece, a holder which surrounds the slotted ring as well as adjusting screws which are arranged at the outer circumference of the holder. In case the dies or rings are arranged in an axial series, as it is necessary for certain operations, significant difficulties are encountered regarding the adjustment of these lapping tools, because each individual lapping die or lapping ring has to be separately set. Thus, the extent of adjustment would depend in a large measure, if not entirely, from the personal judgment of the operator who adjusts the lapping dies or lapping rings. Since the workpieces are packaged in stacks with an axial play for obtaining a slightly spherical contour of the lapped surfaces, it would depend on pure coincidence to locate a jammed workpiece (because of the excessive adjustment of the lapping die or lapping ring) for loosening the corresponding lapping die or lapping ring.

SUMMARY OF THE INVENTION

It is an object of the invention to provide an improved apparatus for the arcuate lapping of a workpiece stack, particularly a piston ring stack, wherein time-consuming and inaccurate radial adjustments of the lapping sleeve are no longer necessary.

This object and others to become apparent as the specification progresses, are accomplished by the invention according to which, briefly stated, the axially slit hollow body is self-tightening, that is, the body is resilient and is, in the operational state, immobilized by a clamping arrangement in a radially expanded, stressed condition.

It is an advantage of the invention as outlined above that the possible wear of the hollow body—as will be explained below—is distributed over a period which ends when, after subsequent radial adjustments, the above-defined self-tightening property ceases to exist. This means that the service life of the tool is increased as compared to conventional closed sleeves.

According to a further feature of the invention, the resilient hollow body is formed of a plurality of resilient split rings arranged to constitute an axial stack and immobilized in an expanded (spread) state. The resilient split rings may be, for example, piston ring rejects which have already been ground to the final axial height, but because of irregularities such as broken edge portions, structural defects and the like, cannot be further machined. Such piston rings or similar annular blanks are arranged in stacks and—if they are not yet split—are slotted in the axial direction. The split rings are expanded on a mandrel and are axially tightened between two supports constituted by clamping discs. Thereafter, if necessary, the inner cylindrical surface of the ring stack is machined to the predetermined inner diameter. The precise operational diameter is obtained by introducing a calibrating mandrel into the ring stack. The diameter of the calibrating mandrel is greater than the inner diameter of the rings in their relaxed (unstressed) state. Thus, when the ring stack is axially unclamped, the rings contract and circumferentially clamp themselves on the outer face of the calibrating mandrel. In this state, the rings are again axially tightened (clamped) to one another and thus immobilized in their calibrated state. Then the calibrating mandrel is withdrawn. In this manner all the rings can be set to the desired working diameter and this adjusting process is repeated during the service life of the ring stack each time a predetermined extent of wear has occurred, until the rings are worn to such an extent that in their relaxed condition their inner diameter is greater than the desired working diameter (that is, the diameter of the calibrating mandrel). In order to facilitate the introduction of the annular workpiece stack as well as the calibrating mandrel into the sleeve formed of the split rings, at least one of the clamping discs has an outwardly flaring inlet opening (centering cone).

By using radially self-tightening individual rings, both the axial and circumferential wear on the inner face of the sleeve (constituted by the split rings) is automatically compensated for, as opposed to closed lapping sleeves structured according to the prior art. As noted before, the ring stack can be radially adjusted until the self-tightening effect lasts.

It is a significant advantage of the invention that by using reject workpiece rings as components of the adjustable lapping sleeve, a significant economy is achieved as compared to the purchase cost of closed, non-adjustable lapping sleeves according to the prior art.

According to the invention, the split rings which form the lapping sleeve may be axially superposed in different ways. Thus, the ring gaps of consecutive rings may be in an axial alignment with one another or they may be offset in the circumferential direction. According to a further stacking arrangement, each split ring has a helical course and the two ring ends overlap. Thus, in the stack the ends of each split ring contact respective ends of the preceding ring and the consecutive ring, whereby the rings in the stack together form a continuous helix.

DESCRIPTION OF THE PREFERRED EMBODIMENTS

Figure 1:
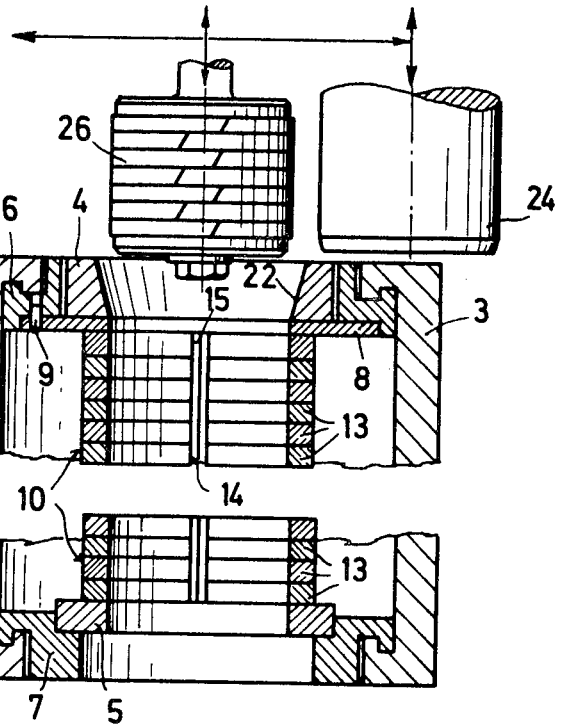
FIG. 1 is an axial sectional view of a preferred embodiment of the invention.

Turning first to FIG. 1, there is illustrated a lapping apparatus according to the invention, generally indicated at 1. The apparatus has an outer casing formed of two longitudinal half-shells 2 and 3 which, in the assembled state, are held together in a closed position. At opposite top and bottom ends of the casing 2, 3 there are supported respective centering rings 6 and 7 as well as clamping rings 4 and 5. An annular disc 8 is positioned over radial faces of the centering ring 6 and the clamping ring 4. The annular disc 8 serves as an anti-rotation device; for this purpose, there is provided a centering pin 9 which extends through both the annular disc 8 and the centering ring 6. Between the clamping rings 4 and 5 there is arranged a ring stack 10 formed of split rings 13, such as piston rings. Each ring 13 is thus discontinuous and has a gap 14. In the embodiment according to FIG. 1, the rings 13 are axially stacked in such an orientation that the ring gaps 14 form a continuous axial slot 15. Prior to axially clamping the rings 13, they are radially resiliently expanded (for example, by a calibrating mandrel) to the desired inner working diameter and thereafter the rings are immobilized by axially urging the clamping discs 4 and 5 to one another by a conventional clamping arrangement. The sleeve formed of the stacked split rings 13 constitutes a lapping tool. The inner face of the sleeve (lapping tool) functions as a lapping surface which cooperates with the external circumferential face of a workpiece stack 26 introduced axially into the apparatus for lapping.

After a certain wear of the inner faces of the rings the apparatus no longer operates properly and thus a radial adjustment of the rings has to be effected to re-establish the desired inner diameter of the lapping sleeve. For this purpose first a calibrating mandrel 24 is introduced into the apparatus through the opening provided in the clamping ring 4 and thereafter the ring stack is unclamped (that is, the axial clamping force on the clamping discs 4 and 5 is removed). Upon this latter occurrence, each radially resiliently expanded split ring 13 is freed from the restraining force of the axial clamping, and as a result each ring 13 contracts and circumferentially clamps itself on the calibrating mandrel 24. Thereupon the ring stack 13 is again axially clamped by the clamping rings 4 and 5 to thus immobilize the rings in their radially inwardly adjusted position. Then the calibrating mandrel 24 is withdrawn and the apparatus is ready for operation in its newly adjusted position. As long as the split rings are still in a resiliently expanded state in their new position, a subsequent adjustment may take place as described.

For facilitating the introduction of the calibrating mandrel 24 or the workpiece stack 26 into the apparatus, the clamping ring 4 is provided with an outwardly flaring centering cone 22.

Figure 2:
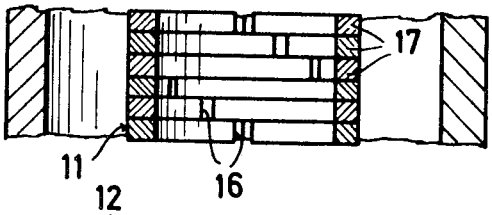
FIG. 2 is a fragmentary axial sectional view of a length portion of another preferred embodiment of the invention.
Figure 3:
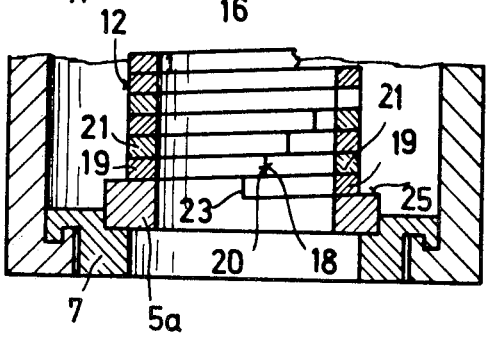
FIG. 3 is a fragmentary axial sectional view of a bottom length portion of still another preferred embodiment of the invention.

FIGS. 2 and 3 show two variants regarding the stacked arrangement of the split rings forming the lapping sleeve.

In FIG. 2 the stack generally indicated at 11 is formed of split rings 17 which are axially superposed in such a manner that the ring gaps 16 are angularly offset with respect to one another.

In the arrangement illustrated in FIG. 3—which shows the bottom part of the apparatus—the stack generally indicated at 12 is formed of a lowermost piston ring 19 and successive piston rings 21 in such a manner that the piston rings, when viewed as a whole, form a continuous helix. For this purpose, each split ring is axially twisted to have a helical course such that the ring ends are in an overlapping relationship. The two ends of each piston ring are in an abutting relationship with the respective ends of an upper and a lower flanking ring. The clamping ring 5*a* has, for properly seating the lowermost split ring 19, a helically rising face 25 and a step 23.

The above description of the present invention is susceptible to various modifications, changes and adaptations, and the same are intended to be comprehended within the meaning and range of equivalents of the appended claims.

What is claimed is:

1. In an apparatus for lapping an external circumferential arcuate face of a workpiece; the apparatus including a sleeve-like lapping tool having an inner face constituting a lapping surface; the improvement wherein the tool has a throughgoing slot to provide for a circumferential discontinuity in said tool and further wherein said tool is radially resiliently expandable; the improvement further comprising axial clamping means for immobilizing said tool; said clamping means having a tightened state in which said tool is immobilized in a radially outwardly deformed condition, whereby said tool, in said tightened state, has internal stresses tending to cause a radially inward contraction of said tool; said clamping means having a released state in which said tool is allowed to contract radially inwardly for circumferentially conforming about an outer face of a calibrating member temporarily positioned within said tool, whereby the inner diameter of said tool is calibrated to a desired working diameter of said apparatus.

2. An apparatus as defined in claim 1, wherein said sleeve-like lapping tool is formed of an axial stack of a plurality of split rings; each ring being radially resiliently expandable; in said tightened state each ring being immobilized by said axial clamping means in a radially resiliently expanded condition.

3. An apparatus as defined in claim 2, wherein each said split ring defines a ring gap; the ring gaps of said stack being in axial alignment with one another.

4. An apparatus as defined in claim 2, wherein each said split ring defines a ring gap; the ring gaps of axially adjoining rings of said stack are offset with respect to one another.

5. An apparatus as defined in claim 2, wherein each said split ring has a helical course and overlapping end portions each having a terminal face; further wherein consecutive rings in said stack being in an end-to-end contacting relationship with respective terminal faces.

6. An apparatus as defined in claim 5, wherein said clamping means comprises at least one clamping disc having a seating face for an outermost said ring of said stack; said seating face having a stepped portion for abutting one of the terminal faces of said outermost ring.

7. An apparatus as defined in claim 2, wherein said clamping means comprises clamping discs respectively engaging two opposite outermost rings of said stack.

8. An apparatus as defined in claim 7, wherein said clamping discs are of annular shape.

9. An apparatus as defined in claim 7, wherein at least one of said clamping discs is annular and has a conical inner wall widening in a direction away from said stack.

* * * * *